US008616392B2

(12) United States Patent
Granger et al.

(10) Patent No.: US 8,616,392 B2
(45) Date of Patent: Dec. 31, 2013

(54) ANTI-FILLING ANTI-SPILL DEVICE FOR BOTTLENECK, COMPOSITE SEALING CAP INCLUDING SAID DEVICE

(75) Inventors: Jacques Granger, Sainte Terre (FR); Jean-Marie Bourreau, Le Pizou (FR)

(73) Assignee: Amcor Flexibles Capsules France, Courbevoie (FR)

( * ) Notice: Subject to any disclaimer, the term of this patent is extended or adjusted under 35 U.S.C. 154(b) by 578 days.

(21) Appl. No.: 12/921,266

(22) PCT Filed: Mar. 11, 2009

(86) PCT No.: PCT/FR2009/000248

§ 371 (c)(1),
(2), (4) Date: Sep. 7, 2010

(87) PCT Pub. No.: WO2009/122028

PCT Pub. Date: Oct. 8, 2009

(65) Prior Publication Data

US 2011/0006029 A1 Jan. 13, 2011

(30) Foreign Application Priority Data

Mar. 11, 2008 (FR) ..... 08 01314

(51) Int. Cl.
*B65D 1/02* (2006.01)
*B65D 49/02* (2006.01)
*B65D 41/00* (2006.01)

(52) U.S. Cl.
USPC ..... 215/18; 215/14; 215/17; 215/21; 215/22; 215/26; 215/30

(58) Field of Classification Search
USPC ..... 215/14, 17, 18, 21–23, 26–27
See application file for complete search history.

(56) References Cited

U.S. PATENT DOCUMENTS

| | | | | | |
|---|---|---|---|---|---|
| 550,013 | A | * | 11/1895 | Beach | 215/22 |
| 631,183 | A | * | 8/1899 | Seelinger | 215/23 |
| 687,236 | A | * | 11/1901 | Ivey et al. | 215/20 |
| 740,285 | A | * | 9/1903 | Koorie | 215/25 |
| 742,592 | A | * | 10/1903 | Clinton | 215/25 |
| 749,570 | A | * | 1/1904 | Luks | 215/25 |

(Continued)

FOREIGN PATENT DOCUMENTS

| | | |
|---|---|---|
| GB | 466474 | 5/1937 |
| GB | 1276619 | 6/1972 |
| WO | 0075033 | 12/2000 |
| WO | 2006134263 | 12/2006 |

*Primary Examiner* — Tri Mai
(74) *Attorney, Agent, or Firm* — Ladas & Parry LLP

(57) ABSTRACT

Anti-filling device to be attached to the neck of a bottle to be closed by a sealing cap, including attachment means for attachment to the bottleneck, a chamber including a lower lip surrounding a lower orifice and confining a moveable part which forms a valve in conjunction with the lower lip, and an axial distribution duct. The device further includes a moveable axial rod, secured to the anti-filling device, the axial movement of which relative to the device is limited between a low position and a high position, and at least one stopper which is in engagement with the moveable axial rod such that, when the moveable axial rod is located in the low position, the stopper shuts an orifice which is arranged in the chamber. The low position is imposed by a projection attached to the cap, which comes into contact with the moveable axial rod when the cap is attached to the bottleneck.

11 Claims, 3 Drawing Sheets

(56) References Cited

U.S. PATENT DOCUMENTS

| | | | | | |
|---|---|---|---|---|---|
| 761,543 | A | * | 5/1904 | Rhodes | 215/25 |
| 768,912 | A | * | 8/1904 | Schook | 215/25 |
| 815,112 | A | * | 3/1906 | O'dell et al. | 215/18 |
| 842,050 | A | * | 1/1907 | Woodard | 215/25 |
| 1,044,173 | A | * | 11/1912 | Hartman | 215/21 |
| 1,137,537 | A | * | 4/1915 | Schnoor | 215/26 |
| 1,148,255 | A | * | 7/1915 | Re | 215/25 |
| 1,183,304 | A | * | 5/1916 | Leitheiser | 215/25 |
| 2,025,498 | A | * | 12/1935 | Desmond | 215/21 |
| 2,057,134 | A | * | 10/1936 | Cahill | 215/17 |
| 3,067,897 | A | | 12/1962 | Incera | |

* cited by examiner

ANTI-FILLING ANTI-SPILL DEVICE FOR BOTTLENECK, COMPOSITE SEALING CAP INCLUDING SAID DEVICE

The invention relates to the field of sealing caps, in particular that of anti-fraud sealing caps for the conditioning of liquid products of great value or highly renown, typically in the field of wines, alcohols, liqueurs or spirits. It relates more particularly to sealing caps for bottles containing beverages with high alcohol content, of which the concentration in sugars is rather high and for which the horizontal storage before and after first opening is likely to present a few problems when they are provided with an anti-filling device.

A large number of patents that describe composite caps comprising a metal shell and provided with a device providing for an anti-fraud or anti-fill function are already known. This device, called anti-filling device, has an axis which coincides with the axis of the neck of the bottle when it is mounted on the bottle. It comprises an anti-return valve, which has the form of a chamber enclosing a moveable part, an axial distribution duct located above said chamber and substantially reversible means of attaching on the neck of the bottle. Once the device is attached on the neck of the bottle, the chamber separates the axial distribution duct from the interior of the bottle. The chamber typically comprises a substantially axial wall of which the lower end is secured to a lower lip delimiting a lower orifice and forming a seat for said moveable part. The upper end of the chamber is occupied by a perforated transversal wall in order to allow for the passage of the liquid towards the axial distribution duct. The moveable part, which in general has a disc stopper or has the shape of a ball, comes, when the bottle is maintained vertical and straight, to bear via gravity against said lower lip and as such shuts the lower orifice by preventing the filling of the bottle from the exterior. However, when the bottle is inclined in order to pour said liquid, the moveable part has a tendency to separate axially from the housing which delimits the lower orifice, which releases the latter and allows for the passage of the liquid from the interior of the bottle towards the exterior.

The attachment of the anti-filling device on the bottleneck is in general carried out either by driving into the interior of the bottleneck, a cylindrical wall—which can be the substantially axial wall of the chamber—being provided exteriorly with at least one annular winglet in conjunction with the internal wall of the bottleneck ("in-bore" arrangement), or by overlapping of the top part of the bottleneck using a fixing skirt provided with a hook or a typically annular bead, attached on said skirt and in conjunction with the hooking zone of the glass ring ("out-bore" arrangement). Many documents describe anti-filling devices. EP 1 100 727, describing an "out-bore" device with pourer and FR 2 406 578 describing an "in-bore" device can be mentioned, for example. International application WO2006/134263 filed by the applicant describes a large number of anti-filling devices, of the "in bore" and "out bore" types. These devices include moreover, above the chamber, an axial distribution duct provided with an additional transversal wall, also perforated and acting as a means of protection of said chamber: while still allowing the liquid contained in the bottle to pass, it prevents the access to the upper portion of the chamber and can only allow this access after irreversible damage, in such a way that any attempt at manipulating the anti-return valve with the purpose of fraudulently filling the bottle again can assuredly be detected.

Patent applications GB 466 474, WO 00/75033 and GB 1 276 619 describe various anti-filling devices comprising a moveable axial rod, of which the axial movement is limited between a low position and a high position, which is associated to a stopper in such a way that, when said moveable axial rod is located in low position, said stopper shuts an orifice which is arranged in the chamber and as such prevents, even when said bottle is maintained horizontally, the flow of the liquid. These devices do not comprise a transversal wall preventing the access to the upper portion of the chamber.

Problems with gluing the moveable part to the wall of the chamber are observed on bottles provided with such caps and containing highly-alcoholic beverages, the content of which in sugars is high, in particular when said bottles have had to be stored horizontally. The gluing of the moveable part to the wall of the chamber alters the operation of the anti-filling device, more particularly when the latter is provided with a disc stopper of which the inertia is lower than that of a ball while the contact surface with the wall of the chamber is often more substantial.

In addition, in order for certain beverages such as vodkas to be advantageously served at low temperature, the bottles are stored in refrigerators and, as the space therein is limited, it is often obliged to store the bottles horizontally. Despite the presence of sealing means typically arranged against the top part of the bottleneck, and possibly against the axial duct or the top part of the anti-filling device, it is observed that a long maintaining of the bottle in horizontal position can lead to losses of alcoholic beverage, resulting then not only in spills along the bottle but also, during the unscrewing of the cap, in a projection of a portion of the alcohol trapped in the chamber of the anti-filling device, in particular when the bottle removed from the refrigerator has remained a certain period of time at room temperature before the unscrewing of the cap.

The applicant has therefore sought to perfect a composite sealing cap provided with an anti-filling device which remains effective after a more or less long period of storage horizontally, even after a first opening, knowing that this results on the one hand in a degradation of the anti-filling function due to a redhibitory gluing of the moveable part on the wall of the chamber and on the other hand any loss of the beverage contained in the bottle by leaking, spilling or projection during the unscrewing of the cap.

DESCRIPTION OF THE INVENTION

A first object according to the invention is an anti-filling device intended to be irreversibly attached to the neck of a bottle intended to contain a liquid and to be closed by a sealing cap, said device comprising substantially reversible attachment means for attachment of said anti-filling device to said bottleneck, a chamber comprising a lower lip surrounding a lower orifice causing the interior of the bottle to communicate with the chamber and confining a moveable part which forms a valve in conjunction with said lower lip, and an axial distribution duct located above said chamber, characterised in that it further comprises a moveable axial rod, secured to the anti-filling device, the axial movement of which relative to said device is limited between a low position and a high position, and at least one stopper in engagement with said moveable axial rod such that, when said moveable axial rod is located in the low position, said stopper shuts an orifice which is arranged in said chamber and prevents, even when said bottle is maintained horizontally, the flow of the liquid.

The description carried out hereinabove follows the normal convention according to which the device is placed on the bottle while the latter is maintained vertical and upright: the axial distribution duct is above the chamber in the sense that it is located between the chamber and the exterior of the bottle. The lower orifice is located at the low portion of the chamber in this sense that it is located on the side of the interior of the bottle.

The device according to the invention comprises on the one hand a moveable part forming a valve in conjunction with the lower lip of the chamber which surrounds the lower orifice and on the other hand a stopper intended to shut an orifice arranged in the chamber. Within the framework of the invention, it is possible that the terms "moveable part" and "stopper" designate the very same part and that "lower orifice" and "orifice" designate the very same orifice. But other embodiments according to the invention, preferred, can have a separate moveable part and stopper, in conjunction with separate orifices. In this latter case, the displacement of the rod being axial, it is advantageous that said stopper and said orifice are in conjunction under the direct effect of the axial movement of the moveable axial rod, i.e. that the stopper is attached to the moveable axial rod or directly driven by the latter and that the orifice is arranged on a transversal wall of the chamber, for example on its upper wall.

Advantageously, the moveable axial rod is maintained in low position when a closure cap is attached on the bottleneck, typically by screwing. To do this, the axial rod is positioned in said anti-filling device in such a way that its upper end is put into contact with a projection secured to the closure cap and is driven by the latter until its low position, reached when said cap is attached on the bottleneck, i.e., typically, completely screwed on said bottleneck.

The rod is secured to the anti-filling device but it can carry out a limited axial movement in relation to the latter. It is referred to as "axial" in the sense that it is oriented parallel to the axis of the device and that it moves parallel to this axis. Advantageously, the moveable axial rod is unique, its axis coinciding with the axis of the device and moving along the axis of the device. Otherwise, it is preferable to provide the device with a plurality of moveable axial rods regularly spaced around the axis. In what follows, in order to facilitate the description, it shall be supposed that it is unique and central. Advantageously, the device is provided with at least one means of maintaining the rod allowing it to be moved according to its axis. This means can be an axial wall wherein the moveable axial rod can slide. It can be an axial bore arranged in a transversal wall of the anti-filling device or the bore of an axial sleeve made secure with the device, for example using attachment arms.

It is recommended that the anti-filling device comprise at least one transversal wall, perforated of course in order to allow the liquid to pass, but which prevents a direct access, starting from the exterior, to the moveable part. This can be the upper wall of the chamber or, as mentioned in WO2006/134263, a protective wall. This shall be referred to in what follows as "upper transversal wall", the transversal wall of the device, arranged in the axial distribution duct or belonging to the chamber, which is exposed to the exterior when the bottle is uncapped.

As said axial rod is called to enter into contact with a projection, preferably also axial, of the cap, a bore must be arranged on the upper transversal wall of the anti-filling device in order to allow said projection to pass. Preferably, this bore is also used to maintain the moveable axial rod and is always shut by the moveable axial rod, even in low position. More preferably, this bore must always be occupied partially by said moveable axial rod: even in high position, the upper end of the latter must not extend beyond the upper surface of the upper transversal wall.

Indeed, as the projection of the cap must have a section that is sufficiently large in order to provide an effective bearing on the moveable axial rod, the bore arranged in the upper transversal wall has a rather large diameter, which allows for the passage of a rod, typically an unfolded paperclip, which can easily reach the moveable part and move it from its housing, as such making possible another filling (fraudulent) of the bottle. It must therefore be avoided that this passage be free when the bottle is uncapped and the best way is to leave the upper end of the moveable axial rod to occupy this passage, even when said moveable axial rod is located in low position. On the other hand, the rod must be able, more preferably, to not extend beyond the upper transversal wall in order to prevent the extending end of the moveable axial rod from being easily grasped from the exterior in order to hinder its axial movement and as such prevent a proper operation of the stopper.

The bore arranged in said upper transversal wall must therefore have a substantial height, greater than the axial travel of the moveable axial rod. As it is unnecessary for the upper transversal wall to be too thick, an axial wall or axial shaft is advantageously attached on said upper transversal wall, acting as a means of maintaining said moveable axial rod, of which the height is greater than the limited amplitude of the movement of the rod. More preferably, said shaft extends downwards, in such a way as to not extend beyond the upper surface of the upper transversal wall. The moveable axial rod is advantageously provided with a shoulder forming an axial abutment in conjunction with the low end of said shaft. It is placed in the anti-filling device in such a way that in low position, the distance d between said shoulder and said low end of the shaft is less than the distance D separating the upper end of said moveable axial rod and the high end of said shaft.

Advantageously, said moveable axial rod is maintained and guided by a second means of maintaining, typically a second axial wall separate from the first, carried by the upper transversal wall. In the case where the latter is a protective wall as in WO2006/134263, the second axial wall can be arranged on the upper wall of the chamber.

In a preferred modality, the anti-filling device comprises a moveable part, in the form of a ball, separate from the stopper, which is a disc secured to the rod coming to bear against the periphery of the upper wall of the chamber. As the disc has a slightly higher tendency than the ball to adhere to its housing, the lower end of the rod is arranged in such a way that it always remains inside the chamber, separate from the ball, when it is in low position of a certain value, typically at least the radius of the ball, more preferably at least the diameter of the ball, in such a way that when the ball is detached from its housing, it comes to strike said end with an energy that is enough to assist, via the rod, the disc in becoming detached from its housing.

Another object of the invention is the unit of a sealing cap and of an anti-filling device such as described hereinabove, wherein said sealing cap is provided with an axial projection and wherein said axial rod is placed in said device in such a way that its upper end is put into contact with said projection and is driven by the latter towards its high position, typically by screwing, during the attachment of said cap on said bottleneck.

Another object of the invention is a composite sealing cap comprising a sealing cap and an anti-filling device according to the invention, the unit being intended to be assembled and attached to the neck of a bottle during the capping of said bottle, characterised in that said anti-filling device is provided with a substantially irreversible attachment means for attachment to said bottleneck and with a temporary attachment means in engagement with a temporary attachment means of said cap and in that said cap is provided with an axial projection, the moveable axial rod of said anti-filling device being placed in said device in such a way that its upper end is placed into contact with said projection and is driven by the latter in such a way that it reaches its low position when said cap stops up said bottleneck. Typically, said temporary attachment means are additional screw threads and the moveable rod is in its low position when said cap is completely screwed on the anti-filling device.

Said sealing cap advantageously comprises a metal shell provided with a head and a metal skirt comprising two portions separated by a weakening line: a lower portion intended to remain secured to the neck of the bottle, for example after having been crimped on the glass ring during the capping, and an upper portion intended to be separated from said anti-filling device and consequently from the bottle, after rupture of the weakening line. After rupture of the weakening line, said upper portion comprises the temporary attachment means for attachment to the anti-filling device which has been anchored on the neck of the bottle: it as such constitutes a moveable conventional sealing cap which can be used to stop up the container after the first opening. According to certain embodiments, the upper portion is directly provided with a temporary attachment means that is complementary to that of the anti-filling device, typically a screw thread. According to other embodiments, the cap comprises an insert attached to the interior of the metal shell provided with said temporary attachment means.

Advantageously, the cap comprises a stopper-insert, typically attached to the lower face of the head of the metal shell, provided with said axial projection which drives said moveable axial rod towards its low position and maintains it in this position as long as the cap stops up the bottleneck, i.e., typically, as long as it is fully screwed on said bottleneck.

In the so-called "out-bore" configurations, said temporary attachment means are used in a first step to assemble the elements of the composite cap, before it is placed on the neck of the bottle and capped and in a second step in order to temporarily attach the conventional sealing cap resulting from the rupture of the weakening line. In the so-called "in-bore" configurations, the anti-filling device being driven into the interior of the neck of the bottle cannot easily itself be provided with means for temporary attachment of the sealing cap. In this case, these temporary attachment means of the cap are located advantageously on an insert and the temporary attachment function between the cap and the anti-filling device is advantageously fulfilled by said axial projection, with, for example, its end which is in engagement with an annular bead arranged at the top of the shaft or the bore of the upper transversal wall.

This invention shall be better understood when studying the embodiments taken by way of examples that are in no way restricted and illustrated by the annexed drawings, wherein:

FIG. 1 diagrammatically shows as a diametral section a sealing cap and a first anti-filling device according to the invention;

FIG. 2 diagrammatically shows as a diametral section a sealing cap and another anti-filling device according to the invention, provided with a transversal wall of protection placed above the upper wall of the chamber;

EXAMPLES OF EMBODIMENTS

Figure 1:
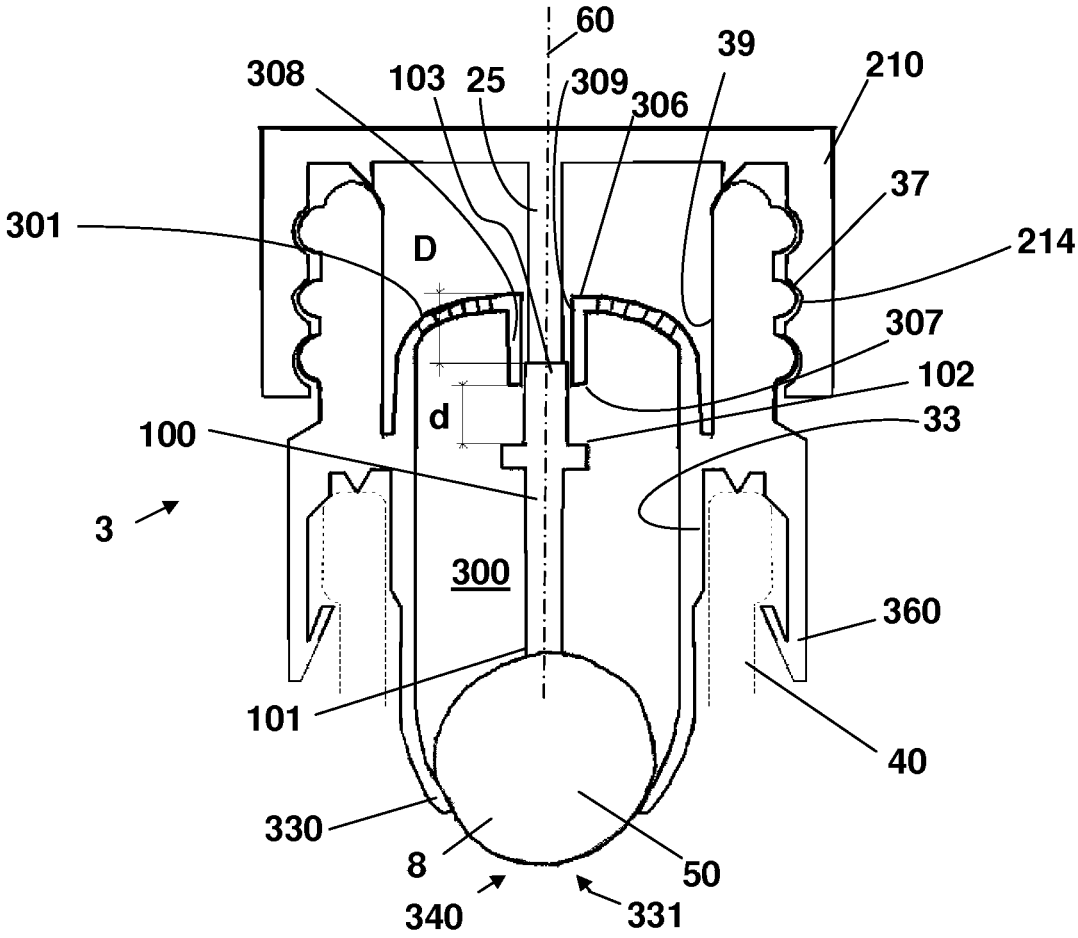
Figure 2:
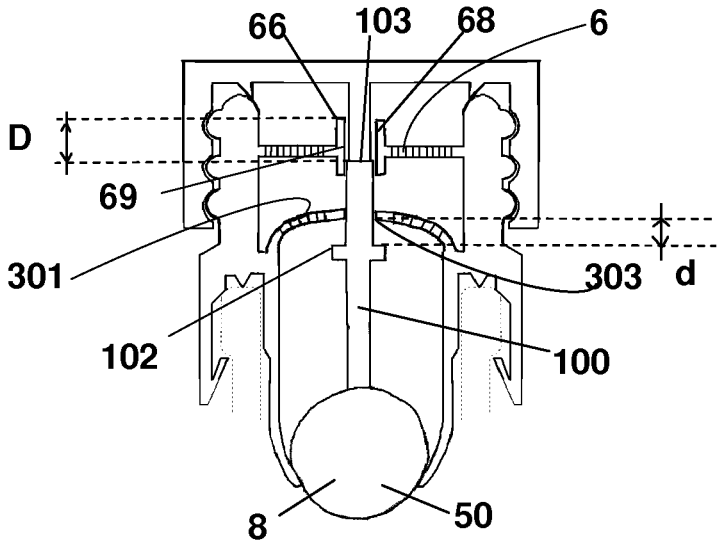

Example 1 (FIGS. 1 and 2)

FIGS. 1 and 2 show two examples where the terms "moveable part" and "stopper" designate the very same part and where "lower orifice" and "orifice" designate the very same orifice.

FIG. 1 shows an anti-filling device 3 intended to be fixed irreversibly to the neck 40 of a bottle. This device has an axis of symmetry 60 which coincides with the axis of the bottleneck when it is mounted on said bottleneck. It comprises substantially reversible attachment means 360 for attachment to said bottleneck, a chamber 300 comprising a lateral wall 33 and a lower lip 330 surrounding a lower orifice 331 causing the interior of the bottle to communicate with the chamber and confining a moveable part 50 which forms a valve in conjunction with said lower lip, and an axial distribution duct 39 located above said chamber. It further comprises a moveable axial rod 100, secured to said device, the axial movement of which relative to said device is limited between a low position and a high position. The moveable part 50 plays the role of a stopper 8 in engagement with said moveable axial rod such that, when said moveable axial rod is located in the low position shown in FIG. 1, its low end 101 comes to bear on the moveable part which shuts the orifice 340 which coincides with the lower orifice 331, in such a way that it prevents the flow of the liquid, even when the bottle is maintained horizontal.

A sealing cap 210 is provided with a screw thread 214 that is complementary with the thread 37 arranged on an exterior wall of the anti-filling device. The axial rod 100 is positioned in said device in such a way that its upper end 103 is put into contact with a projection 25 secured to the cap 210 and is driven by the latter towards its high position at the end of the screwing of said cap on said bottleneck. The axial rod can carry out a limited axial movement d. The device 3 is provided with a means of maintaining the rod which allows it to move according to its axis: this is an axial bore 309 arranged in a shaft 308 secured to the upper wall 301 of the chamber 300.

The moveable axial rod 100 is provided with a shoulder 102 forming an axial abutment in conjunction with the low end 307 of said shaft. It is placed in the anti-filling device 3 in such a way that in low position, the distance d between said shoulder 102 and said low end 307 of the shaft 308 is less than the distance D separating the upper end 103 of said moveable axial rod 100 and the high end 306 of said shaft.

As such, this bore 39 is always occupied by the moveable axial rod 100, even when the latter is located in low position. Moreover, even in high position, the upper end 103 of this moveable axial rod does not extend beyond the surface of the upper wall 301 of the chamber 300 which is here the upper transversal wall of the device 3, exposed on the exterior when the bottle is uncapped.

FIG. 2 shows an example that is slightly different from that in FIG. 1. In this example, the moveable part 50 which always acts as a stopper 8 but the upper wall 301 of the chamber 300 is overmounted by an upper transversal wall 6, typically playing the role of the perforated protective wall described in application WO2006/001328. This upper transversal wall 6 is provided with a shaft 68 having a bore 69 through which slides the rod 100. The moveable axial rod 100 is provided with a shoulder 102 forming an axial abutment in conjunction with the lower surface 303 of the upper wall 301 of the chamber. It is placed in the anti-filling device in such a way that in low position, the distance d between said shoulder 102 and said lower surface 303 of the upper wall 301 is less than the distance D separating the upper end 103 of said moveable axial rod 100 and the upper end 66 of the shaft 68.

Figure 3:
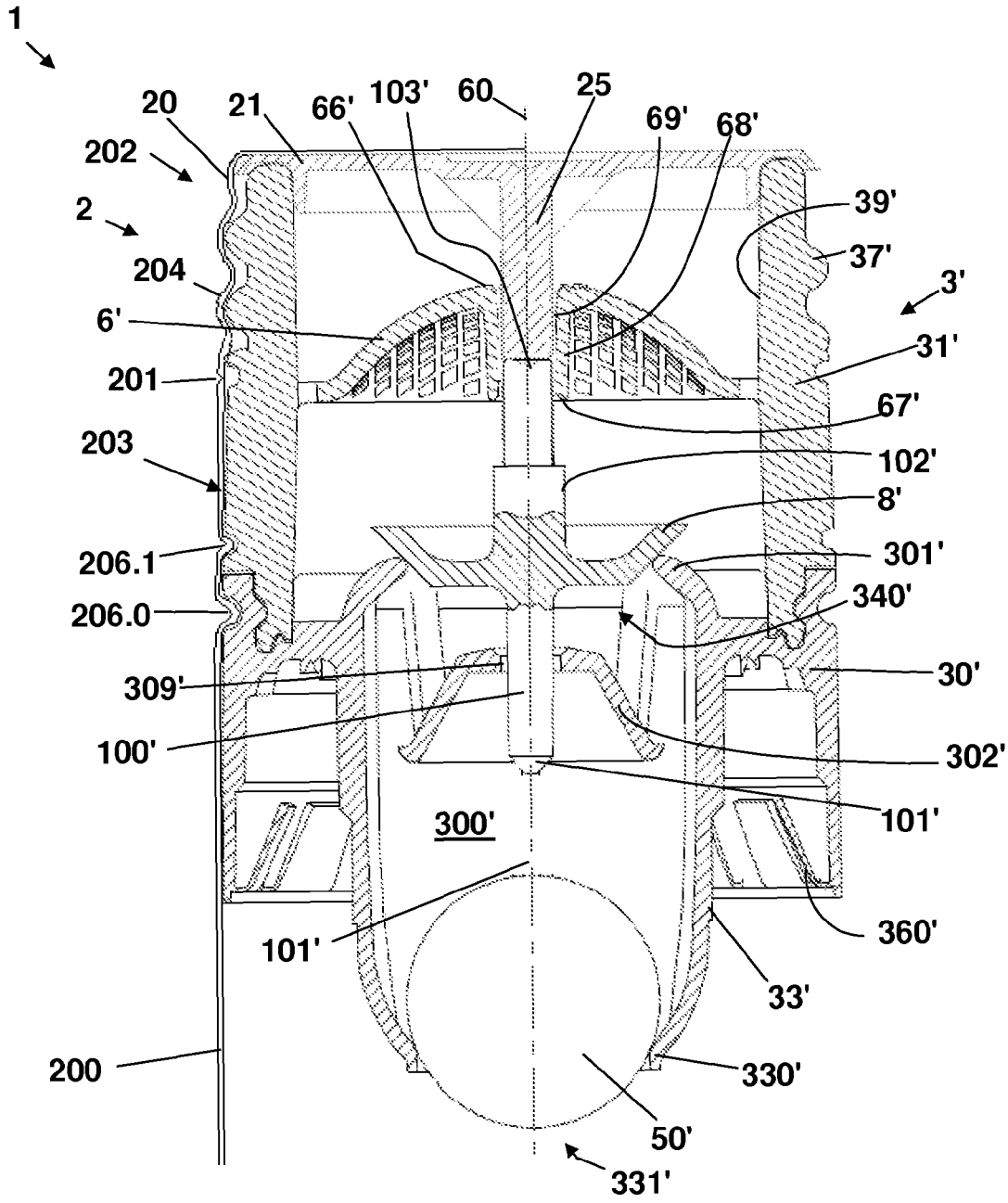
FIG. 3 shows, in diametral section for the anti-filling device and as a diametral half-section for the shell, a composite sealing cap according to the invention, the anti-filling device being of the "out-bore" type.

Example 2 (FIG. 3)

In this example and in the following examples, the moveable part and the stopper are separate and are in conjunction with separate orifices: the stopper 8' is attached to the moveable axial rod 100' and the orifice 340' is arranged on the upper wall 301' of the chamber 300'.

The anti-filling device 3' is of the "out-bore" type. It comprises a means of substantially irreversible attachment, here an annular attachment hook 360'. It comprises a chamber 300' with a lateral wall 33' and a lower lip 330' surrounding a lower orifice 331' and confining a moveable part 50'. An axial distribution duct 39' is located above the chamber. It further comprises a moveable axial rod 100'. When the latter is located in the low position shown in FIG. 3, the stopper 8' comes to bear on the peripheral portion of the upper wall 301' of the chamber 300' and shuts the orifice 340'.

The axial rod 100' is placed in said device in such a way that its upper end 103' is put into contact with a projection 25 secured to the closure cap 2 and is driven by the latter towards its high position at the end of screwing. The axial rod can carry out a limited axial movement. The device 3' is provided with a means of maintaining the rod allowing it to be moved according to its axis: this is an axial bore 69' arranged in a shaft 68' secured to the upper transversal wall 6', which, in this case, is domed and has the form of a grid.

The moveable axial rod 100' is provided with a shoulder 102' forming an axial abutment in conjunction with the low end 67' of said shaft. It is placed in the anti-filling device 3' in such a way that in low position, the distance between said shoulder 102' and said low end 67' of the shaft 68' is less than the distance separating the upper end 103' of said moveable axial rod 100' and the high end 66' of said shaft.

On the left portion in FIG. 3, an example of composite sealing cap 1 can be seen resulting from the assembly of the anti-filling device 3' and of a sealing cap 2. The unit is made integral thanks to the conjunction of the threads 204 and 37'. It is intended to be assembled and attached to the neck of a bottle during the capping of said bottle, where it is fitted around the bottleneck then driven in such a way that the annular hook 360' is folded by passing around the glass ring, its end being released elastically after said passage and as such being trapped by the glass ring. The cap is provided with a stopper-insert 21, which itself is provided with an axial projection 25. The moveable axial rod 100' is placed in the device 3' in such a way that its upper end 103' is put into contact with said projection and is driven by the latter towards its high position when said cap is completely screwed on said anti-filling device.

The sealing cap 2 comprises a metal shell 20 provided with a head and a metal skirt 200 and comprises two portions separated by a weakening line 201: a lower portion 203 intended to remain integral with the neck of the bottle and an upper portion 202 intended to be separated from said anti-filling device after rupture of the weakening line 201. After rupture of the weakening line, said upper portion constitutes a moveable conventional sealing cap.

The anti-filling device 3' results from the assembly of a low portion 30', which carries the chamber 300' and the means of irreversible attachment 360' to the bottleneck, and of a high portion 31' which carries the upper transversal wall 6' which is used as a protective wall. These portions are maintained integral via snap-fitting means and two crimped zones 206.0 and 206.1 of the metal skirts, with one deformed on a groove arranged in the low portion 30' and the other in the high portion 31'.

The moveable axial rod 100' is also maintained and guided by a second means of maintaining 309': this is a bore carried by the central portion 302' of the upper wall 301' of the chamber 300'.

The moveable part 50', is a ball separate from the stopper 8', which is a disc, attached to the rod 101' perpendicular to its axis and coming to bear against the periphery of the upper wall 301' of the chamber 300'. As the disc has a higher tendency than the ball to adhere to its seat, the lower end 101' of the rod is arranged in such a way that it always remains inside the chamber, at a distance from the ball, when it is in low position, by a value corresponding at a minimum to the radius of the ball, in such a way that when the ball is detached from its seat, it comes to strike said end with an energy that is sufficient to assist, via the rod, the disc in becoming detached from its seat.

Figure 4:
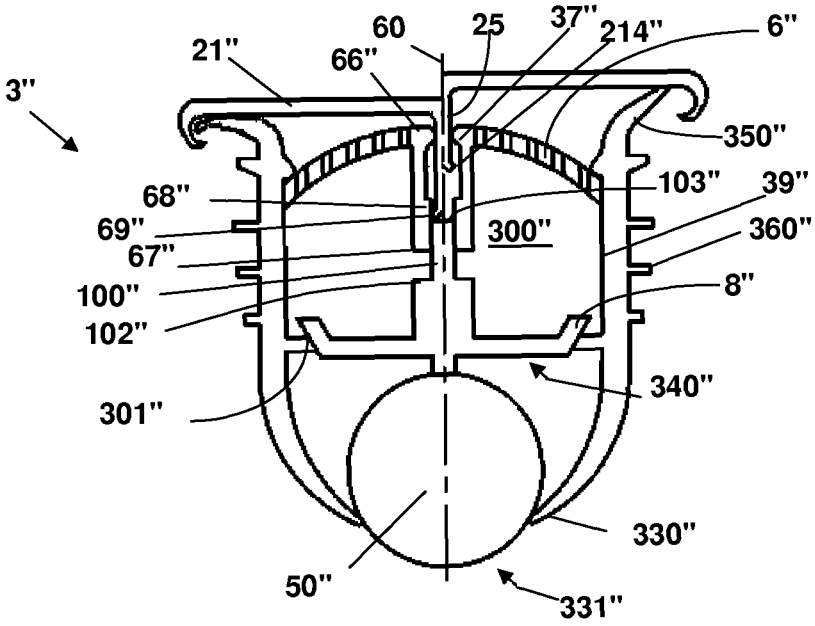
FIG. 4 shows in an incomplete manner another composite sealing cap according to the invention, with an anti-filling device of the "in-bore" type and the stopper-insert of the cap: the diametral half-section on the right shows the device when the sealing cap is not screwed and the diametral half-section on the left shows the device when the sealing cap is screwed.

Example 3 (FIG. 4)

Here also, the stopper 8" is attached to the moveable axial rod 100" and the orifice 340" is arranged on the upper wall 301" of the chamber 300".

The anti-filling device 3" is of the "in-bore" type. It comprises substantially reversible attachment means, which are here a set of flexible circular winglets 360" arranged on the exterior surface of the transversal wall of the axial distribution duct 39" and intended to be in conjunction with the interior of the bottleneck, in such a way as to provide a firm and sealed link between the device 3" and the bottleneck. It comprises a chamber 300" with a lower lip 330" surrounding a lower orifice 331" and confining a moveable part 50". It further comprises a moveable axial rod 100". When the latter is located in the low position shown in the left portion of FIG. 4, the stopper 8" comes to bear on the peripheral portion of the upper wall 301" of the chamber 300' and shuts the orifice 340".

The axial rod 100" is placed in such a way that its upper end 103" is put into contact with a projection 25 secured to the closure cap and is driven by the latter towards its low position at the end of screwing. It can carry out a limited axial movement. The device 3" is provided with an axial bore 69" arranged in a shaft 68" secured to the upper transversal wall 6", which here is domed and has the form of a grid. The moveable axial rod 100" is provided with a shoulder 102" forming an axial abutment in conjunction with the low end 67" of said shaft. It is placed in the anti-filling device 3" in such a way that in low position, the distance between said shoulder and said low end of the shaft is less than the distance separating the upper end 103" of said moveable axial rod 100" and the high end 66" of said shaft.

The device 3" further comprises a flexible lip 350" acting as a pourer. This lip sinks under the effect of the cap when the latter is screwed on the neck of the bottle. On the left portion in FIG. 4, the stopper-insert 21" can be seen, secured to the cap which is shown in an incomplete manner, in a sunken-in position. The end of the projection 25, which is attached to said stopper-insert 21", comes into contact with the upper end 103" of the rod 100" and sinks in the latter by driving it towards its high position, where the stopper 8" comes to shut the orifice 340".

Through a conjunction between the annular bead 37" located at the top of the shaft 66" and the forked end 214" of said axial projection 25, the latter also fulfils a temporary attachment function between the cap and the anti-filling device.

Figure 5:
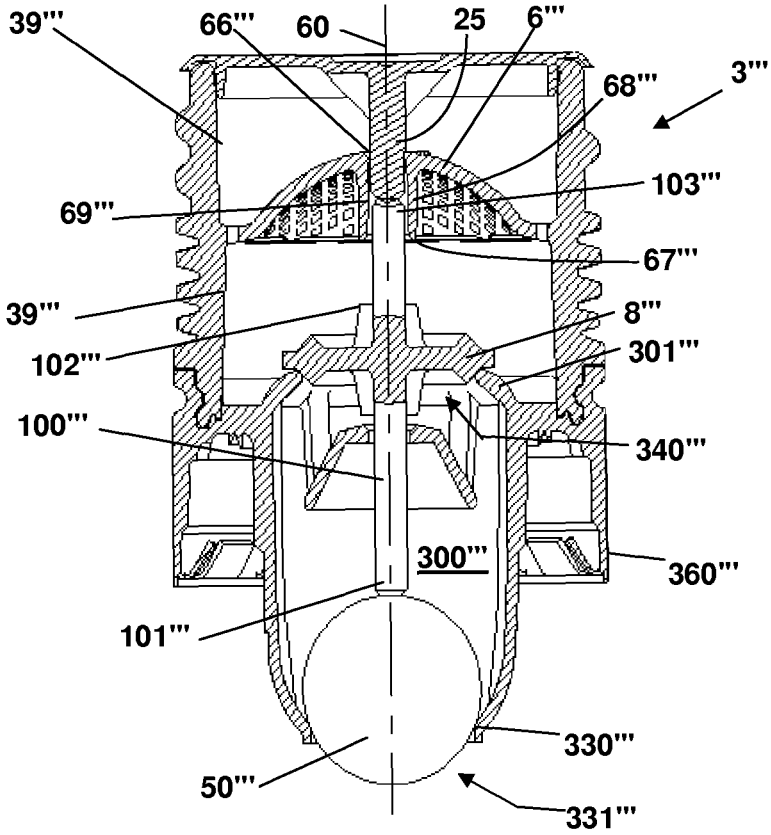
FIG. 5 shows in an incomplete manner, in diametral section, another composite sealing cap according to the invention, with an anti-filling device of the "out-bore" type and a stopper-insert.

Example 4 (FIG. 5)

The anti-filling device 3'" in this example is close to that in example 2. It differs from it in the fact that the rod 100'" is extended in such a way that in low position, not only the stopper 8'" comes to bear on the peripheral portion of the upper wall 301'" of the chamber 300'" in order to shut the orifice 340'" but also the lower end 101'" of said rod comes to bear on the moveable part 50'", which comes flush against the lower lip 330'" and shuts the lower orifice 331'". The device 3'" is provided with a means of maintaining the rod allowing it to be moved according to its axis: this is an axial bore 69'" arranged in a shaft 68'" secured to the upper transversal wall 6'". The moveable axial rod 100'" is provided with a shoulder 102'" forming an axial abutment in conjunction with the low end 67'" of said shaft. It is placed in the anti-filling device 3'" in such a way that in low position, the distance between said shoulder 102'" and said low end 67'" of the shaft 68'" is less than the distance separating the upper end 103'" of said moveable axial rod 100'" and the high end 66'" of said shaft.

The invention claimed is:

1. A combination comprising a sealing cap and an anti-filling device, the combination being configured for attachment to the neck of a bottle during the capping of said bottle, said cap comprising an axial projection, said anti-refilling device comprising a substantially reversible attachment means for attachment of said anti-filling device onto said neck, said anti-refilling device comprising a chamber having a lower lip surrounding a lower orifice causing the interior of the bottle to communicate with said chamber, and confining a moveable part which forms a valve in conjunction with said lower lip, and an axial distribution duct located above said chamber, said anti-refilling device comprising a moveable axial rod, secured to said anti-filling device, and at least one stopper in engagement with an orifice arranged on a transverse wall of the chamber or the upper wall of the chamber, wherein said stopper is configured to shut said orifice to prevent the flow of liquid, said anti-refilling device comprising an upper transversal wall, and an axial bore to maintain said moveable axial rod, wherein the upper end of the movable axial rod does not extend beyond the upper surface of said upper transversal wall.

2. The combination according to claim 1 wherein said stopper is attached to said moveable axial rod or directly driven by the axial rod and wherein said orifice is arranged on a transversal wall of the chamber, or on an upper wall of the chamber.

3. The combination according to claim 1, wherein said upper transversal wall is provided with a shaft and said moveable axial rod, provided with a shoulder forming an axial abutment in conjunction with the low end of said shaft, is placed in the anti-filling device in such a way that in low position, the distance d between said shoulder and said low end of said shaft is less than the distance D separating the upper end of said moveable axial rod and the high end of said shaft.

4. The combination according to claim 1, wherein said moveable axial rod is maintained and guided by a second means of maintaining.

5. The combination according to claim 1, comprising a moveable part in the form of a ball and a stopper in the form of a disc secured to said moveable axial rod coming to bear on the periphery of the upper wall of said chamber, the lower end of said rod always remaining inside said chamber, and being, in low position, separate from said ball by a distance of at least the radius of said ball, in such a way that when said ball is detached from its seat, it comes to strike said end with an energy that is sufficient to assist, via said rod, said disc in becoming detached from its seat.

6. The combination according to claim 1, wherein said attachment means are additional screw threads, said moveable axial rod being located in its low position when said cap is completely screwed on said anti-filling device.

7. The combination according to claim 1, wherein said sealing cap comprises a metal shell composed of a head and of a skirt and comprising two portions separated by a weakening line, a lower portion being secured to the neck of the bottle after having been crimped on the glass ring during capping, and an upper portion that is separated from said anti-filling device after rupture of said weakening line and thus to form a moveable sealing cap.

8. The combination according to claim 7, wherein the cap comprises a metal shell and an insert which is attached to the interior of said shell and provided with said temporary attachment means that is complementary to that of said anti-filling device.

9. The combination according to claim 7, wherein said upper portion is provided with said temporary attachment device that is complementary to that of said anti-filling device.

10. The combination according to claim 1, wherein said cap is provided with a stopper-insert comprising said axial projection which drives said moveable axial rod towards its low position and maintains it in this position as long as the cap stops up the bottleneck.

11. The combination according to claim 9, wherein said attachment device is a screw thread.

* * * * *